US007909991B2

(12) United States Patent
Hernandez

(10) Patent No.: US 7,909,991 B2
(45) Date of Patent: Mar. 22, 2011

(54) SWIMMING POOL SKIMMER AND DEBRIS CLEANING DEVICE

(76) Inventor: Patrick Hernandez, Converse, TX (US)

( * ) Notice: Subject to any disclaimer, the term of this patent is extended or adjusted under 35 U.S.C. 154(b) by 14 days.

(21) Appl. No.: 12/250,664

(22) Filed: Oct. 14, 2008

(65) Prior Publication Data

US 2010/0089842 A1 Apr. 15, 2010

(51) Int. Cl.
*E04H 4/16* (2006.01)

(52) U.S. Cl. ..... 210/167.19; 210/470; 210/499; 4/490; 4/496; 242/397.5

(58) Field of Classification Search ..... 210/747, 210/776, 167.19, 167.2, 242.1, 470, 499; 4/490, 496; 242/397.5
See application file for complete search history.

(56) References Cited

U.S. PATENT DOCUMENTS

| | | | | | |
|---|---|---|---|---|---|
| 238,153 | A | * | 2/1881 | Piper | 242/397.5 |
| 2,367,997 | A | * | 1/1945 | Chambers | 210/167.19 |
| 4,088,317 | A | | 5/1978 | Gierla | |
| 4,089,074 | A | | 5/1978 | Sermons | |
| 4,176,419 | A | | 12/1979 | MacDonald | |
| 4,251,038 | A | * | 2/1981 | Gename | 242/397.5 |
| 4,472,842 | A | * | 9/1984 | Jarrett | 4/490 |
| 4,518,495 | A | | 5/1985 | Harding | |
| 4,557,001 | A | * | 12/1985 | Burkhart | 4/490 |
| 4,836,920 | A | * | 6/1989 | Miller, Jr. | 210/167.19 |
| 4,879,028 | A | | 11/1989 | Gibson | |
| 5,043,060 | A | | 8/1991 | Brennan | |
| 5,085,767 | A | | 2/1992 | Beers | |
| 5,139,660 | A | | 8/1992 | Lourie et al. | |
| 5,167,805 | A | | 12/1992 | Theiss | |

(Continued)

*Primary Examiner* — Christopher Upton
(74) *Attorney, Agent, or Firm* — Kammer Browning PLLC

(57) ABSTRACT

A device for skimming the surface of the water in a swimming pool or the like, in a single, generally sweeping motion and thereby collecting most all of the debris floating on or near the surface of the pool into one spot where it may be lifted and removed from the pool. The system incorporates a long rectangular section of netting that is wound onto a cylindrical reel and contained on a vertically oriented cylindrical axel. The cylindrical axel and reel are mounted by brackets or weights to the side of the pool. The cylindrically wound netting may be drawn out from the fixed cylinder mounted on the side of the pool through a slot in a pivoting debris deflector positioned on the same cylindrical axel. One end of the long rectangular section of netting may be fixed to a second smaller cylinder or pipe which serves to keep the net from being drawn completely into the enclosure comprising the cylindrical reel. A handle may be inserted into the smaller cylinder or pipe to allow the user to withdraw the end of the net from the cylinder and direct the extension of the net out around the edge of the pool in a progressive fashion. As the long rectangular net is extended and the end is carried about the edge of the pool, debris collects to a single point as the end of the net is finally brought back to the fixed cylindrical reel location. The cylindrical device is positioned so as to extend vertically across the horizontal water line in the pool in such a manner that some part of the net extends below the water while some part of the net extends above. The cylindrical reel is preferably spring loaded, such that as the net is withdrawn, spring tension tends to hold and draw the net back as the end progresses about the edge of the pool. Various stops and cleaning mechanisms positioned on the debris deflector component of the cylindrical reel facilitate the collection of debris and prevent the debris from being pulled into the cylindrical reel upon retraction of the net.

15 Claims, 4 Drawing Sheets

U.S. PATENT DOCUMENTS

| | | | | |
|---|---|---|---|---|
| D336,329 | S | 6/1993 | Gosselin et al. | |
| 5,223,135 | A | 6/1993 | MacPhee et al. | |
| 5,487,830 | A | 1/1996 | Huppert | |
| 5,510,020 | A | 4/1996 | Gronlund | |
| 5,525,217 | A | 6/1996 | Fulop | |
| 5,614,085 | A | 3/1997 | Platt, III | |
| 5,911,878 | A | 6/1999 | Benvenuto et al. | |
| 5,951,858 | A * | 9/1999 | Soto et al. | 210/167.2 |
| 6,132,604 | A | 10/2000 | Kirchoff | |
| 6,270,683 | B1 | 8/2001 | Turner | |
| 6,989,093 | B1 | 1/2006 | Greathead | |
| 7,297,079 | B1 | 11/2007 | Delauter | |
| 2004/0108259 | A1 | 6/2004 | Giannantonio | |
| 2004/0182768 | A1 | 9/2004 | Blackman et al. | |
| 2005/0011819 | A1 | 1/2005 | Gillen et al. | |
| 2006/0060513 | A1 | 3/2006 | Craig | |
| 2006/0104720 | A1 | 5/2006 | Haski et al. | |
| 2007/0181475 | A1 * | 8/2007 | Blake | 210/167.19 |

* cited by examiner

SWIMMING POOL SKIMMER AND DEBRIS CLEANING DEVICE

BACKGROUND OF THE INVENTION

1. Field of the Invention

The present invention relates generally to swimming pools and systems for cleaning debris from the water contained within swimming pools. The present invention relates more specifically to a compact device for skimming the water surface of a swimming pool in order to efficiently collect and remove floating debris from the water in the pool.

2. Description of the Related Art

All swimming pools, both smaller residential pools and larger public or institutional swimming pools, require a significant amount of maintenance in order to provide a safe, enjoyable, and hygienic swimming experience to the users of the pool. Swimming Pool maintenance efforts primarily include the circulation and filtration of the water contained in the pool, and the maintenance of the proper levels of chemicals (such as chlorine) designed to eliminate the growth of bacteria, algae, and other undesirable organisms. While most pool water circulation systems include some level of debris filtration, their primary objective is to prevent stagnation within the water through aeration and to maintain the appropriate levels of chemical additives. Most swimming pool water circulation systems are not structured to adequately collect and remove the larger bits of debris that almost always find their way into the swimming pool from the surrounding environment (from vegetation and the like).

There have been many efforts in the past to design systems that are directed to the removal of larger objects of debris from the surface of the water within a swimming pool and/or from within the entire volume of the swimming pool water. Most objects of debris that find their way into a swimming pool are generally airborne and, being less dense than water, will typically float on top of the surface of the pool water, as they primarily comprise leaves, sticks, grass clippings, and other bits of paper, trash, or other organic material. Most of the systems designed and developed to remove this debris from the pool therefore focus on that part of the debris that floats at or near the surface of the pool.

Most efforts in the past have therefore focused on devices and systems for skimming the debris off the surface of the water within the confined walls of the swimming pool without the removal of water from the pool at the same time. Generally, these prior efforts fall into one of three categories: (1) hand manipulated screens that may be directed across the surface of the water in the pool while the user (or users) stands on the edge of the pool; (2) screening devices designed to be incorporated into the side of the pool in association with a flow of water through the pool's circulation system; and/or (3) floating devices that move about the surface of the water in the pool and collect debris into any of a number of different nets or filters. Efforts have therefore been made in the past to provide skimmers that are hand manipulated for use by an individual walking around the perimeter of the pool, as well as systems that are fixed in position on the side of the pool as part of the swimming pool water circulation system.

A typical example of a hand manipulated pool skimmer is seen in U.S. Pat. No. 1,632,604 issued to Kirchoff entitled Pool Skimmer which describes the use of an elongated pole handle and at least one skimming net assembly. The pole handle has opposite proximal and distal ends and each skimming net assembly includes an open frame and a net screen. The open frame defines a central opening which net material is fixed across. One end of the open frame is pivotally coupled to the distal end of the pole handle. The other end of the open frame is adapted for detachable attachment to the end portion of the open frame of another skimming net assembly. The Kirchoff patent therefore describes a device that includes a long two-handled set of netted hoops that one or more individuals may move across the surface of the pool to collect debris. The device does not lend itself to easy use by a single individual and does not serve to collect the debris in a single compact location.

A floating skimmer type device is disclosed in U.S. Pat. No. 4,089,074 issued to Sermons entitled Leaf Skimmer for Pools. This patent discloses a cleaning device for swimming pools that has a floating member that is positioned on the surface of the water in the pool adjacent to and upstream of a water circulation drain for the pool. Attached to the floating member is a net immersed in the water for collecting debris in the proximity of the drain. The floating member is preferably tethered to the side of the pool so as to be easily removable at pre-determined intervals for dumping the debris. The Sermons patent discloses a system that does include the semi-permanent attachment of an anchor to the side of the pool, but relies upon the directed circulation flow of the pool water into the drain element already positioned on and incorporated into the side of the pool. The system would function poorly if it was not specifically positioned in association with a circulation drain.

Two additional prior disclosures, U.S. Pat. No. 5,139,660 issued to Lourie et al. entitled Swimming Pool Skimmer, and U.S. Pat. No. 5,223,135 issued to MacPhee et al. entitled Swimming Pool Cleaner, each describe rigid rectangular structures that are designed to be moved or manipulated by two individuals positioned on either side of the swimming pool simultaneously. The McPhee et al. patent describes the use of a net that may be completely or partially rolled up with one of the side members of the frame for storage. In addition, U.S. Pat. No. 5,085,767 issued to Beers entitled Swimming Pool Skimming Apparatus is directed to the removal of debris from the water surface of swimming pools and comprises a buoyant tube arrayed along its entire length with a fibrous absorbent material affixed to each of the extreme ends of the tube. The skimming apparatus may be swept across the pool and then wound with one end inside the other until the inner circle has been reduced to a diameter of two or three feet. Although the Beers patent describes a device does a better job of concentrating the debris for removal, it still relies upon a wide area floating component that is difficult to reduce in size and store when not in use.

A number of additional prior U.S. patents disclose single ended hand manipulated mechanisms that are either moved about the perimeter of the pool or are pivoted about a point of attachment on the side of the pool to collect debris. These types of devices are typified by U.S. Pat. No. 5,591,858 issued to Soto et al. entitled Device for Cleaning the Surface of the Body of Water in a Pool; U.S. Pat. No. 5,510,020 issued to Gronlund entitled Swimming Pool Skimmer; and U.S. Pat. No. 5,487,830 issued to Huppert entitled Stationary Skimming Device for a Swimming Pool.

None of the efforts made in the prior art disclose the use of a compact net that may be extended across the pool surface and progressively moved about the pool in order to gather debris to a single location. It would be desirable to have a system that, when not in use, was compactly stored in a convenient position on or near the edge of the pool in a manner such that it is immediately ready for use at any time. It would be desirable if such a system allowed for the extension of the collection net out from its stored placement in a manner such that, with a single movement, and by a single user, it would be capable of collecting most all of the debris floating on the surface of the swimming pool into a single location, where it could be then be easily removed from the pool. It would be desirable if such a system would allow for the easy extension and retraction of the collection net out from and into a compact storage configuration, and concurrently provided a means for cleaning the collection net of the debris to prevent it from clogging the stored net system.

SUMMARY OF THE INVENTION

The present invention therefore provides a device for skimming the surface of the water in a swimming pool or the like, in a single, generally sweeping motion and thereby collecting most all of the debris floating on or near the surface of the pool into one spot where it may be lifted and removed from the pool. The system incorporates a long rectangular section of netting that is wound onto a cylindrical reel and contained on a vertically oriented cylindrical axel. The cylindrical axel and reel are mounted by brackets or weights to the side of the pool. The cylindrically wound netting may be drawn out from the fixed cylinder mounted on the side of the pool through a slot in a pivoting debris deflector positioned on the same cylindrical axel. One end of the long rectangular section of netting may be fixed to a second smaller cylinder or pipe which serves to keep the entire rectangular net from being drawn completely into the enclosure comprising the cylindrical reel. A longer handle may be inserted into the smaller cylinder or pipe and thereby allow the user to withdraw the end of the net from the cylinder and direct the extension of the net out around the edge of the pool in a progressive fashion. In this process, the net gathers debris floating on the surface of the pool and, as the long rectangular net is extended and the end is carried about the edge of the pool, debris collects to a single point as the end of the net is finally brought back to the fixed cylindrical reel location. The cylindrical device is positioned so as to extend vertically across the horizontal water line in the pool in such a manner that some part of the net extends below the water while some part of the net extends above. In this manner, pulling the net from the cylindrical reel provides a means for collecting all of the debris floating on the surface of the pool. The cylindrical reel is preferably spring loaded, such that as the net is withdrawn, spring tension tends to hold and draw the net back as the end progresses about the edge of the pool. Various stops and cleaning mechanisms positioned on the debris deflector component of the cylindrical reel facilitate the collection of debris and prevent the debris from being pulled into the cylindrical reel upon retraction of the net.

Further objectives and advantages will be readily apparent to those skilled in the art from the following description with reference to the appended drawings.

DETAILED DESCRIPTION OF THE PREFERRED EMBODIMENTS

Figure 1:
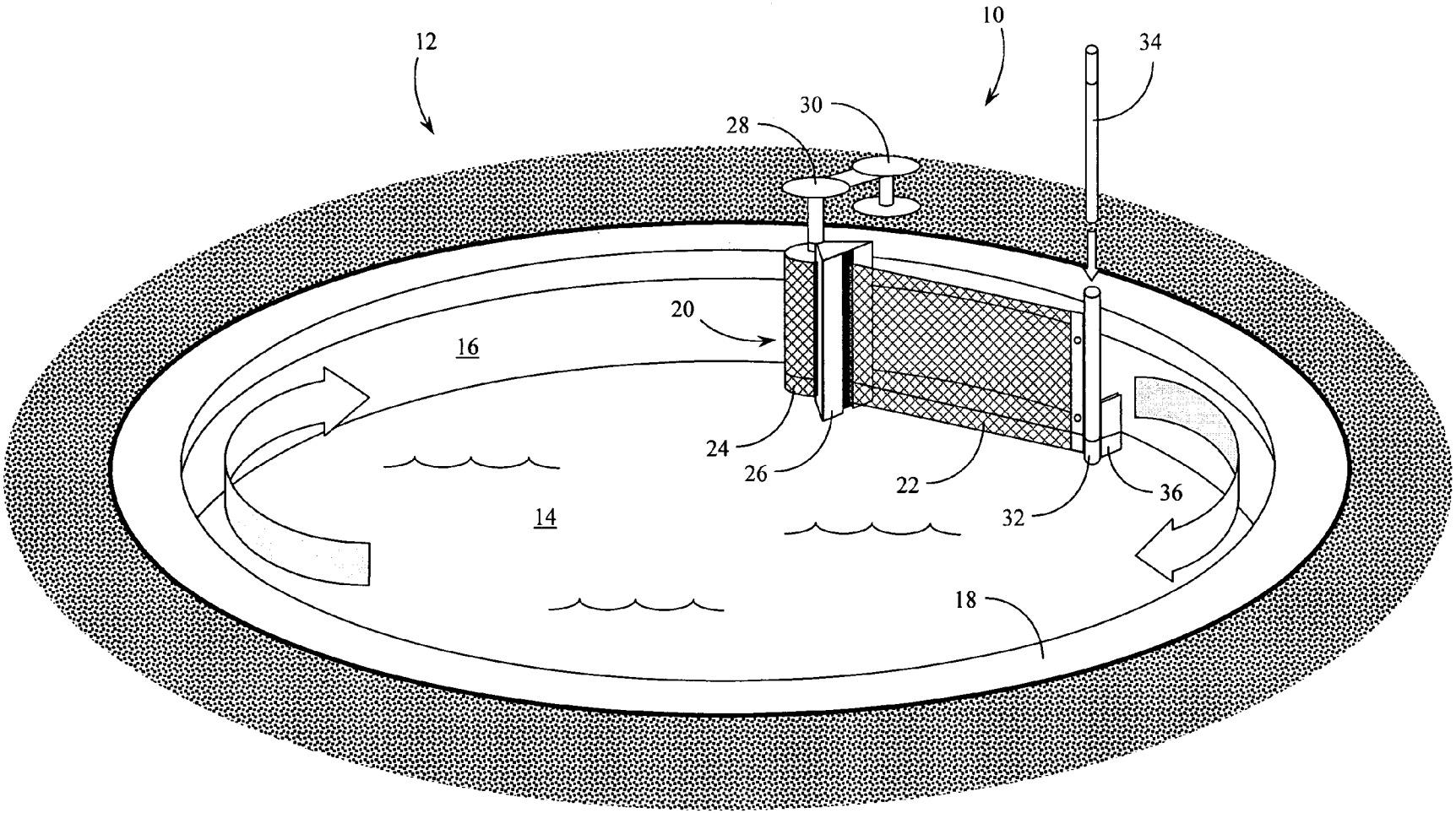
FIG. 1 is a perspective view of the swimming pool skimmer system of the present invention shown positioned in place along the edge of a swimming pool.

Reference is made first to FIG. 1 for a description of the complete swimming pool debris skimming device of the present invention as it might be installed in conjunction with the sidewall or edge of a typical swimming pool. The swimming pool 12 shown in FIG. 1 is a simple circular or oval shaped swimming pool provided as an example for clarity as one shape with which the system of the present invention may be used. Those skilled in the art will recognize that a swimming pool of nearly any configuration may utilize the system of the present invention without difficulty. Therefore, alternative shapes and sizes to the swimming pool 12 show in FIG. 1 are anticipated. For very large swimming pool facilities and installations it may be preferable to incorporate more than a single apparatus of the present invention to accommodate the more rapid collection and removal of debris from the pool. There are, however, no specific size limitations for the swimming pool that would benefit from the installation and use of the system of the present invention.

In FIG. 1, debris skimming device 10 is shown placed on the edge 18 of swimming pool 12. The level of pool water 14 is indicated on the side of the pool along the sidewall 16 of the pool. Net reel assembly 20 of the present invention is shown positioned in place on the edge of the pool 12 as described in more detail below. A portion of the extended net 22 is shown in FIG. 1 as the system might be configured when the user is initially extending the net from the cylindrical net storage device. The movement of the user in the configuration shown in FIG. 1 would be in a clockwise direction around the perimeter of the pool, starting adjacent to the cylindrical storage components of the device, progressing around the perimeter of the pool, and then returning back to the cylindrical storage components with the collected debris.

In general, the debris skimming device 10 of the present invention is comprised of two primary components, the net reel component 20 and the extendable end tube assembly 32. Connecting these two components is a generally rectangular length of net 22 as shown. The net reel component 20 is fixed in position on the edge of pool 12 while the extended net end tube 32 is free to be drawn out away from the net reel 20 and moved about the edge of the pool as shown. In this manner the net 22 is extended from net reel 20 and is directed across the surface of the water in the pool, gradually encompassing and collecting most all of the debris that is floating on the surface of pool water 14.

Net reel assembly 20 is positioned on the edge 18 of pool 12 by means of net reel support 28 and net reel fixed pedestal 30. As indicated above, a variety of different mechanisms and structures for locating net reel assembly 20 on the edge of the pool 12 and maintaining it in a fixed position will be apparent to those skilled in the art. The device may be semi-permanently mounted to the side of the pool as with bolts or other attachment means fixed into the concrete structure of the pool walls and/or perimeter walkways. Alternately, the device may be positioned using a heavily weighted pedestal that remains in position on the walkway or edge surrounding the pool, despite the relatively small lateral forces exerted on the device during its use. The important requirements are that the cylindrical reel be laterally fixed in position on the edge of the pool while being free to rotate in a manner that allows for the extension and retraction of the net with little effort or force.

Associated with net reel 20 are cylindrically wound net 24 and pivoting leaf guard 26. The operation of these components is described in more detail below. In general, net reel 20 provides a cylindrical reel of net material that may be extended out for use and retracted back into a stored condition when not in use. In the preferred embodiment, net reel 20 comprises a spring loaded reel assembly that automatically retracts the extended net as the user allows the net to be returned back towards the reel component 20 after having been progressed about the perimeter of the pool.

When not in use, all but the very end of the longitudinal rectangular net is retracted back into net reel 20 to a point of contact between pivoting leaf guard 26 and extended net end tube 32. The user initiates use of the pool skimming device of the present invention by grasping removable handle 34 and inserting it into one end of extended net end tube 32. Once placed into extended net end tube 32, the user may manipulate removable handle 34 to draw extended net 22 away from net reel 20 along the edge 18 of pool 12. Positioned on extended net end tube 32 is pool side wall scraper 36 which the user may direct against the side wall 16 to scrape any debris immediately adjacent the side wall into the main area of pool water 14 where it may be gathered and eventually collected by extended net 22. The user is free to manipulate extended net end tube 32 and the associated pool side wall scraper 36 in any manner to gradually or rapidly collect the debris into the net as the user moves about the perimeter of the pool while standing on edge 18 of the pool.

The user may extend the net 22 out from net reel 20 to a point of maximum distance from net reel 20, as for example, to an opposite or furthest edge of the pool. From that furthest point forward in progressing about the perimeter of the pool, the net reel gradually and automatically retracts the extended net 22 while the user returns to a position adjacent net reel 20 after circumnavigating the entire pool edge. As extended net 22 is retracted back into net reel 20, debris that is collected in the net is prevented from entering the cylindrically wound net 24 by way of pivoting leaf guard 26. In a manner described in more detail below, the debris being collected by the extended net 22 is brushed back into the mass of debris still floating on the surface of pool water 14, but held within a confined area by the remaining portion of extended net 22. As the net is at all times defining an ever decreasing closed area, the debris in the pool is confined and gathered back to a single location where it can more easily be removed ( in a manner described below).

Figure 2:
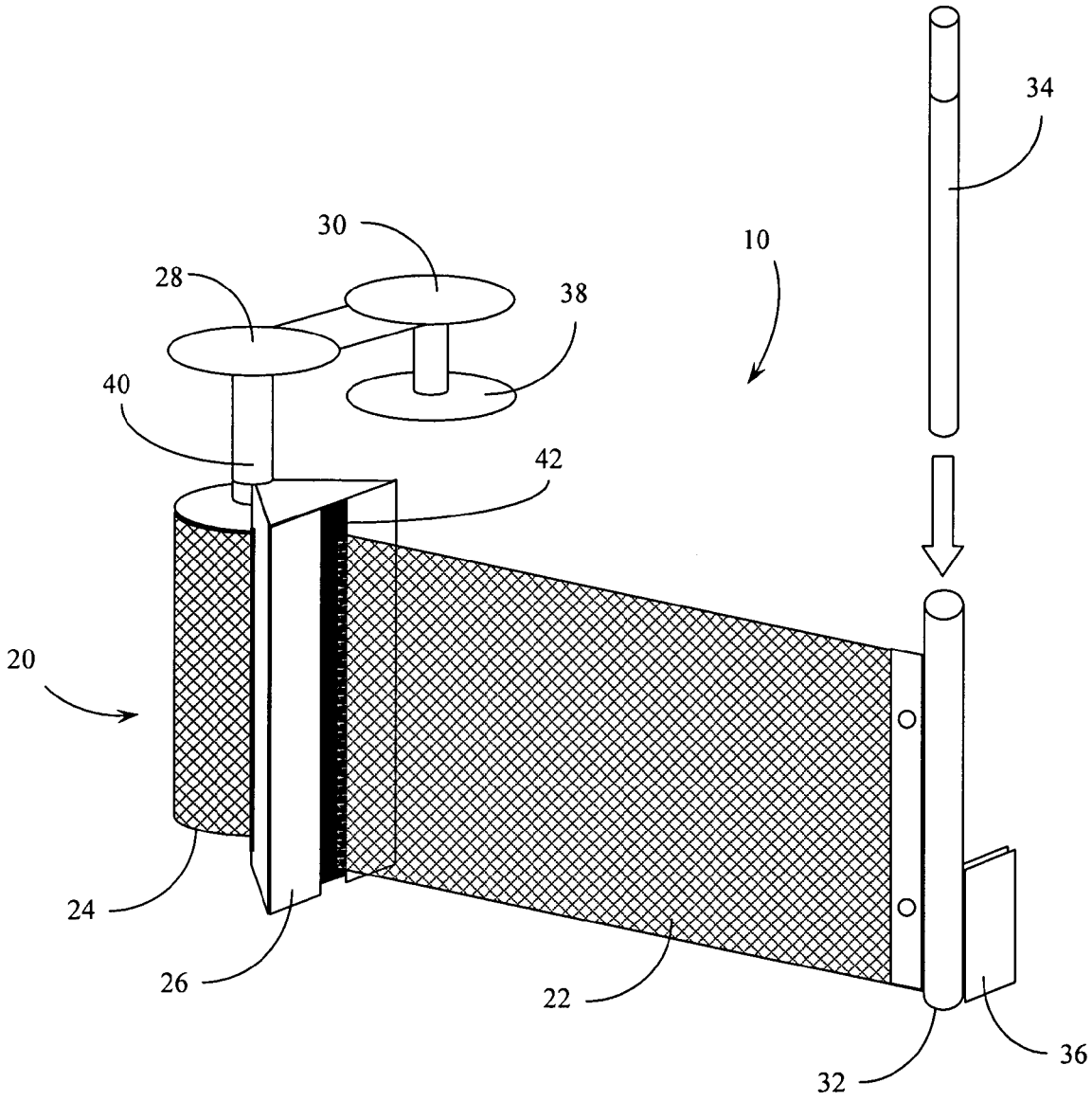
FIG. 2 is a detailed perspective view of the swimming pool skimmer system of the present invention showing the various components in the system.

Reference is now made to FIG. 2 for a more detailed description of the components of debris skimming device 10 of the present invention. Again, the system is comprised primarily of net reel 20, which in the preferred embodiment is fixed on the edge of the pool, and extended net end tube 32 which is manipulated by the user with the help of removable handle 34. In the detailed view shown in FIG. 2, the manner of attaching extended net 22 to extended net end tube 32 can be seen. Typically a pair of flat gripping flange plates positioned on either side of extended net 22 may be clamped together to hold extended net 22 in an upright position across its extended width along the length of the end tube 32. In the preferred embodiment, end tube 32 may comprise a section of PVC pipe to which is attached the short width dimension of the rectangular net in the manner described above. Alternately, the end tube may a section of PVC pipe with a longitudinal slit cut into the pipe, into which the end of the net might be placed and secured. Pool side wall scraper 36 may be positioned at an angle or away from the attachment point for extended net 22 onto extended net end tube 32 in a manner that allows the user to lead with the scraper against the wall of the pool and follow with the extended net as the end assembly is directed about the perimeter of the pool.

Net reel 20 is again comprised primarily of cylindrically wound net section 24 and pivoting leaf guard 26 which are each connected to a spring loaded reel axle 40 which allows the rotational movement of both wound net 24 and pivoting leaf guard 26 about net reel support 28. Net reel fixed pedestal 30 is rigidly attached to net reel support 28 and is in turn positioned on fixed mounting base 38 which, as described above, may preferably be either a heavy weighted stand or a heavy plate more permanently fixed to the side of the pool. In this manner, the bracket components comprising net reel support 28, net reel fixed pedestal 30, and fixed mounting base 38 remain rigidly positioned on the edge of the pool and maintain net reel 20 in a fixed lateral position, while still allowing net reel 20 and its associated pivoting leaf guard 26 to rotate in any direction and to unwind the extended net 22 as described above.

Figure 3:
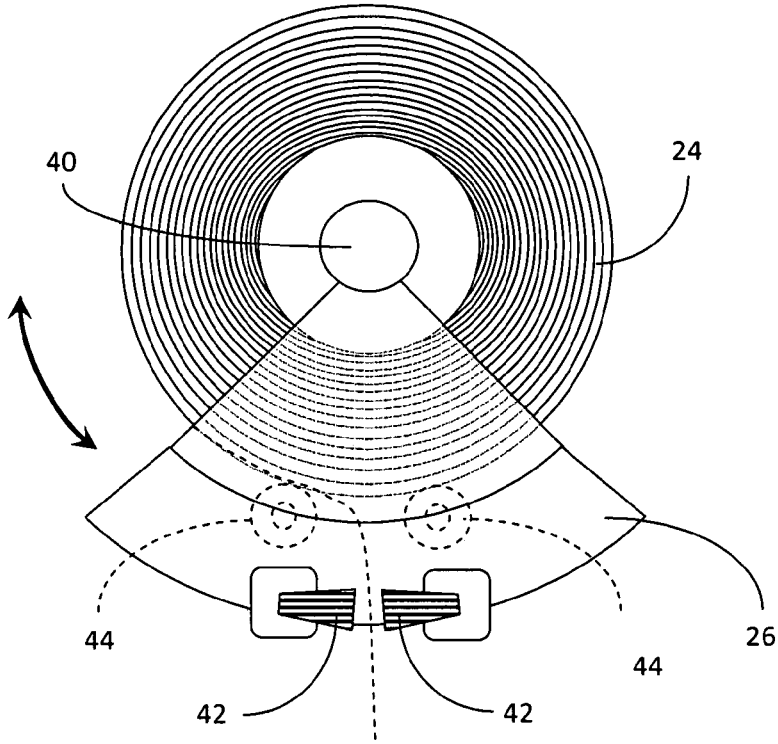
FIG. 3 is a top plan view of the net reel of the system of the present invention showing the pivoting leaf guard.
Figure 4:
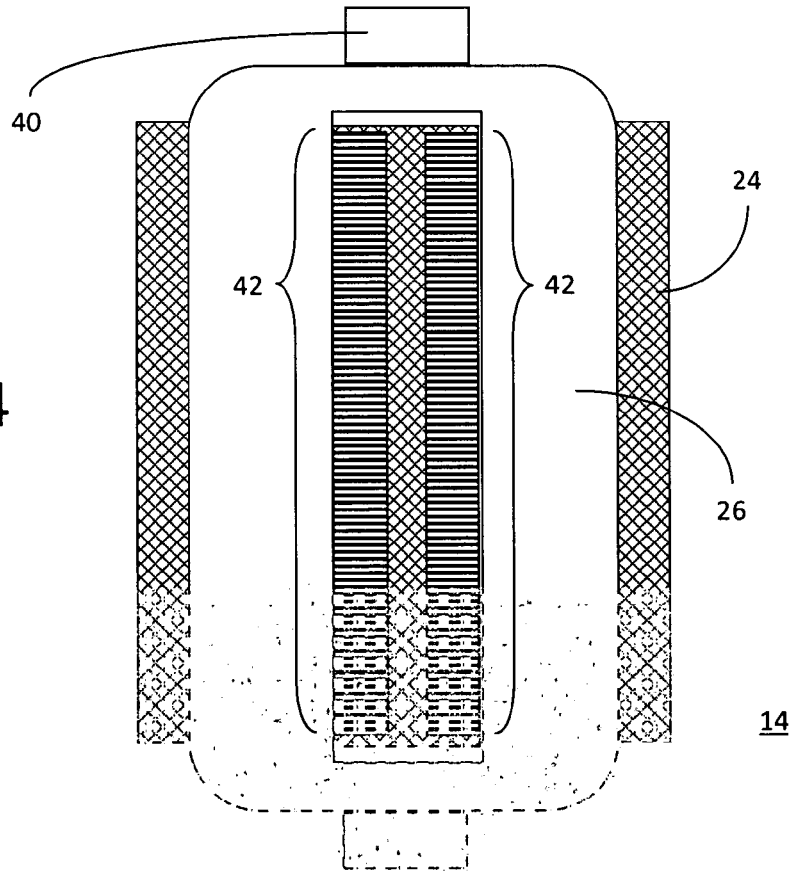
FIG. 4 is a side plan view of the net reel of the system of the present invention showing the pivoting leaf guard partially immersed in the swimming pool water.

Reference is now made to FIGS. 3 and 4 for a more detailed description of the structure of net reel 20 and its manner of allowing the extension and automatic retraction of the skimming net used in the system of the present invention. FIG. 3 is a top plan view of net reel 20 of the present invention shown without net reel support 28 in order to expose the basic internal structures of the net reel. Spring loaded reel axle 40 is shown centrally positioned within net reel 20 around which is collected wound net 24. A fixed end (not seen in FIG. 3) of wound net 24 is permanently attached to spring loaded reel axle 40 and the opposite end extends from the wound cylindrical reel out through pivoting leaf guard 26 to its point of attachment to end assembly 32.

Pivoting leaf guard 26 pivots about spring loaded reel axle 40, although it is not associated with the spring loaded functionality of net reel 20. Pivoting leaf guard 26 is simply free to rotate at any angle as indicated in FIG. 3 with respect to the central axis defined by spring loaded reel axle 40. The extendable end of the net is, of course, left positioned on the external surface of cylindrically wound net 24 and passes through leaf guard 26 between two net guide rollers 44. These vertically oriented rollers help guide the release of the net when it is extended from net reel 20 and also assist in winding the net back around net reel 20 on retraction.

Most importantly in FIG. 3 are shown leaf guard brushes 42 which are positioned in a vertical arrangement on either side of the opening in leaf guard 26 through which the end of wound net 24 extends. These leaf guard brushes, shown in profile in FIG. 4, are spaced sufficiently apart from each other as to allow for the easy extension and retraction of the net from net reel 20 while at the same time sufficiently close as to serve to brush debris outward upon retraction of the net, in a manner that prevents the debris from clogging net reel 20 and becoming wound into cylindrically wound net 24. Any smaller particles of debris that do make it between leaf guard brushes 42 end up on the external surface of wound net 24 and are free to fall therefrom into the collection area on the surface of the pool. For this reason net reel 20 is preferably an open reel with only the leaf guard covering a small portion of the outward facing surface of the cylindrical structure.

The spacing between leaf guard brushes 42 is once again established so as to prevent all but the smallest bits of debris from entering into the cylindrically wound net 24. FIG. 4 further shows the approximate depth at which the system of the present invention might be placed within pool water 14. The width of the net that collects the debris in the present invention may preferably be on the order of 1' to 2' in order to allow an adequate range of vertical motion to the user without the risk of losing debris above or below the net as it might cross the water line. In this manner, it is preferable to position the net reel 20 such that the surface of the pool water 14 is approximately mid-way along the height of the net reel 20 thus allowing for an increase or a decrease in the level of the pool water surface as typically occurs through evaporation and the filling or re-filling of the pool.

Figure 5:
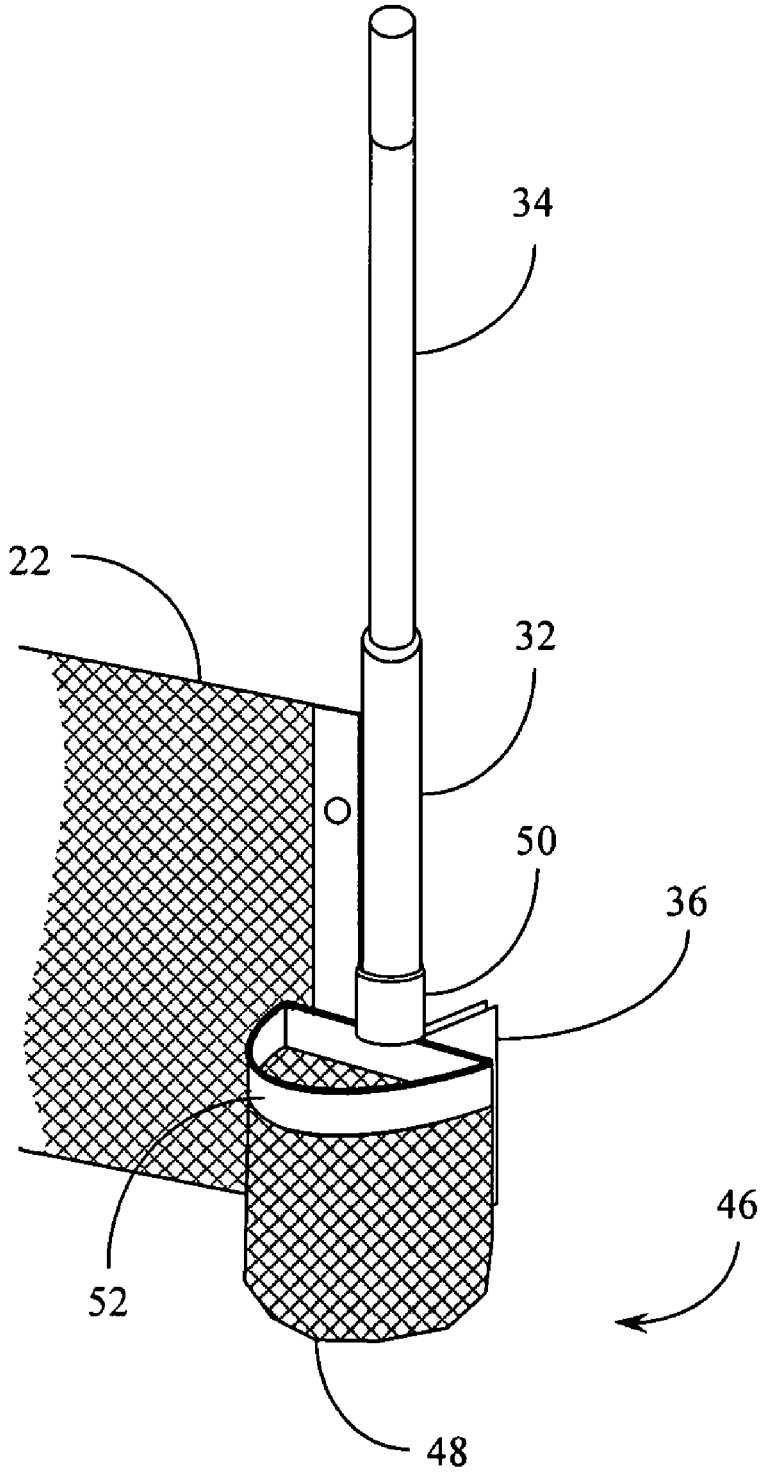
FIG. 5 is a detailed perspective view of the swimming pool skimmer system of the present invention showing an optional debris lifting basket.

Reference is finally made to FIG. 5 for a detailed description of an optional component of the swimming pool skimmer system of the present invention. FIG. 5 discloses in detail the extended net end tube 32 and the removable handle 34 positioned as they are at the end of extended net 22 as described above. Pool side wall scraper 36 is again positioned at an angle with respect to the attachment point for extended net 22. As an optional component, debris lifting basket 46 may be attached to extended net end tube 32 in a manner that allows the user to lift debris from the surface of the pool after a full sweep of the pool with the primary net. The debris lifting basket 46 of the present invention is positioned in a convenient location on the hand manipulated extended net end tube 32 where the user may readily utilize the basket to remove debris that has been collected by the system of the present invention. A convenient structure to debris lifting basket 46 is shown in FIG. 5 wherein debris lifting basket 46 comprises a basket net 48 that is configured and supported by basket rim 52 which itself is supported by basket support clip 50. Support clip 50 is configured to be clipped onto or easily removed from cylindrical extended net end tube 32. This also allows lifting basket 46 to rotate slightly about extended net end tube 32 in a manner most convenient for the user. The user may simply lift the entire assembly out from the pool and then either dump the contents of the basket directly or remove the lifting basket 46 from its clipped position on extended net end tube 32 for easy disposal of the contents of the net basket at a remote location.

Although the present invention has been described in terms of the foregoing preferred embodiments, these descriptions are provided by way of explanation only and are not intended to be construed as limitations of the invention. Those skilled in the art will recognize modifications of the present invention that would accommodate specific swimming pool structures and specific user needs. Those skilled in the art will further recognize additional methods for modifying the manner of attachment of the system of the present invention to the swimming pool wall or edge. Such modifications as to structure, orientation, geometry, and configuration for the components, where such modifications are coincidental to the type of swimming pool involved or the specific user's requirements, do not necessarily depart from the spirit and scope of the invention.

I claim:

1. An apparatus for skimming the surface of the water in a swimming pool to collect debris floating on the surface into a single location, the device comprising:

a cylindrical reel of net material fixed in a position on a perimeter edge of the pool and extending into the pool such that the cylindrical reel is partially submerged into the water in the pool, the cylindrical reel comprising a cylindrically wound length of net material having a fixed end and a free end, the net material capable of being wound and unwound from a cylindrical configuration;

a debris diversion guard comprising a pivoting perimeter panel defining a slot through which the free end of the net material extends, the perimeter panel comprising a generally narrow, cylindrical radial section positioned outside a minor portion of the perimeter of the cylindrical reel, leaving a major portion of the perimeter of the cylindrical reel open, the debris diversion guard further comprising radial arms extending from a pivot point on a common axis with the cylindrical reel of net material, the debris diversion guard pivoting independently of the cylindrical reel of net material; and a net end assembly attached to the free end of the net material in a manner that allows an extension of the net material from the cylindrical reel of net material to a range of positions about the pool in a manner that sweeps debris on the surface of the pool.

2. The apparatus of claim 1 wherein the cylindrical reel of net material is spring loaded so as to preference the retraction of the net material upon extension of the free end of the net material away from the cylindrical reel.

3. The apparatus of claim 1 wherein the net end assembly comprises a cylindrical end tube with the free end of the net material attached along a length of the end tube.

4. The apparatus of claim 3 wherein the net end assembly further comprises an extension handle, the extension handle removably attachable to an end of the cylindrical end tube.

5. The apparatus of claim 3 wherein the net end assembly comprises a debris lifting basket, the basket removably positioned on the cylindrical end tube.

6. The apparatus of claim 1 wherein the net end assembly comprises a side wall scraper for contacting the side wall of the pool and directing debris away from the wall into the net material.

7. The apparatus of claim 1 wherein the net end assembly comprises a debris lifting basket.

8. The apparatus of claim 1 wherein the debris diversion guard further comprises at least one brush assembly positioned within the slot defined in the pivoting perimeter panel in loose contact with the free end of the net material, the at least one brush assembly serving to prevent debris on the net material from being retracted through the debris diversion guard into the cylindrical reel.

9. The apparatus of claim 1 wherein the debris diversion guard further comprises at least one roller assembly positioned adjacent the free end of the net material on the cylindrical reel side of the pivoting perimeter panel of the debris diversion guard, the at least one roller assembly serving to facilitate the winding and un-winding of the net material onto and from the cylindrical reel.

10. The apparatus of claim 1 further comprising a mounting bracket rotationally supporting the cylindrical reel of net material and fixed on the perimeter edge of the pool.

11. The apparatus of claim 10 wherein the mounting bracket is semi-permanentlyfixed on the perimeter edge of the pool with rigid fastener devices.

12. The apparatus of claim 10 wherein the mounting bracket is temporarily fixed on the perimeter edge of the pool with a weighted base.

13. An apparatus for skimming the surface of the water in a swimming pool to collect debris floating on the surface into a single location, the device comprising:

a cylindrical reel of net material fixed in a position on a perimeter edge of the pool and extending into the pool such that the cylindrical reel is partially submerged into the water in the pool, the cylindrical reel comprising a cylindrically wound length of net material having a fixed end and a free end, the net material capable of being wound and unwound from a cylindrical configuration; and a net end assembly attached to the free end of the net material in a manner that allows an extension of the net material from the cylindrical reel of net material to a range of positions about the pool in a manner that sweeps debris on the surface of the pool, the net end assembly further comprising a debris lifting basket.

14. The apparatus of claim 13 wherein the net end assembly comprises a cylindrical end tube with the free end of the net material attached along a length of the end tube.

15. The apparatus of claim 14 wherein the debris lifting basket is removably positioned on the cylindrical end tube.

* * * * *